United States Patent [19]

Jackson et al.

[11] Patent Number: 4,809,390

[45] Date of Patent: Mar. 7, 1989

[54] POP-OPEN DISPOSABLE DEBRIS COLLECTOR

[76] Inventors: Albert R. Jackson, 707 S. Bentley St., Marion, Ill. 62959; James L. Martin, Poplar & McKinley St., Stonefort, Ill. 62987

[21] Appl. No.: 198,008

[22] Filed: May 24, 1988

[51] Int. Cl.[4] ..... A47L 13/52

[52] U.S. Cl. ..... 15/257.9; 15/257.1; 229/41 R; 294/1.3; 493/942

[58] Field of Search ..... 15/257.1, 257.4, 257.6, 15/257.9; 294/1.3; 229/41 R; 493/942

[56] References Cited

U.S. PATENT DOCUMENTS

| | | | |
|---|---|---|---|
| 2,924,841 | 2/1960 | Seibert | 15/257.9 |
| 3,345,670 | 10/1967 | Charie | 15/257.1 |
| 3,995,807 | 12/1976 | Dell'Anno | 15/257.1 |
| 4,251,097 | 2/1981 | Whitten, II | 294/1.3 |

*Primary Examiner*—Edward L. Roberts
*Attorney, Agent, or Firm*—J. Gibson Semmes

[57] ABSTRACT

A collapsed, pop-open and disposable debris collector formed of a semi-rigid blank the composition of which has a folded elastic memory, the collector forming interconnected rear abutment, side walls and a bottom, the side walls lapping the rear abutment wall in part in a collapsed configuration; permanent adhesive on the rear wall, securing a portion of the lapping side walls to the exterior of the rear abutment wall and spring-like foldable abutment retaining tabs projecting from each side wall, extensible upon setting up to engage the interior of the rear wall upon pop-opening of the collector from collapsed to pop-open utility configuration; the collector having an integral handle at the rear and a no-spill lip at the forward open end and pressure sensitive adhesive which is coextensive with the no-spill lip to coact therewith in the utility mode. The debris collector is readily adapted to stack packaging.

6 Claims, 4 Drawing Sheets

POP-OPEN DISPOSABLE DEBRIS COLLECTOR

BACKGROUND OF INVENTION

1. Field of the Invention:

This pop-open disposable debris collector and trash retrieval cleaning implement is formed from a crisp semi-rigid blank of plastic or paper composition and is adapted to provide the user with disposable pop-up means for utilization in dusting and related surface cleanup functions as for example at institutions, in the home, and like quarters. It is particularly suitable to compact, nestable and stack packaging, wherein respective individual collectors may be superposed one upon another with individual antiseptic covers therefor. The collapsible and tension restrained nature of the disposable collector is such that it may also be packaged in pop-open superposed multiples, wherein contiguous collector implements may be compressed rolled and contained as for example in a packaging cylinder or similar container. Alternatively, each of the dust pan collector implements may be collapsibly packaged in superposed, stacked relation to each other, as will be more fully described hereinafter. During the stack packaging of the elements comprising the invention, they are in collapsed, somewhat flexible form. The content of the blank material comprising each individual dust pan element is such that it is flexible for purposes of packaging but when correctly released from packaging and assembled for purposes of utility, it obtains a substantial self-supporting rigidity wherein by rebounding coaction of elements, the construction rigidity is enhanced. It is impermeable to fluids.

2. Description of the Prior Art:

The prior art is best represented by the following patents to: 34,644 U. D. Alexander Nov. 23, 1880 354,600 M. N. Hemenway Dec. 21, 1886 2,453,973 W. E. Coats Nov. 16, 1948 2,666,309 R. L. Anderson Apr. 4, 1950 2,924,841 H. E. Seibert Feb. 16, 1960 3,676,887 Stanley R. Klein Jul. 18, 1972 3,971,503 R. J. Allen Jul. 27, 1976 4,154,389 S. Dell 'Anno May 15, 1979.

In each of these patents, representing the scope of the prior art, little effort has been undertaken to eliminate excessive cumbersome extensions, keys and locks, normally required to effect rigidity to a given product. In some instances, such as in Anderson, additional fastening elements such as rivets and stays are required. Additionally, there is little prospect, utilizing the disposables of the prior art, to effect a unique pop-up implemental rigid formation from a single blank, with the additional purpose of packaging in a manner such as to insure the sanitary quality of the product and the prospect of compact tubular and/or stack packaging. In the present construction for packaging and/or utility, the composite nature of the material forming the blank is critical. It must exhibit a characteristic of rebounding, once it has been folded; that is it must have a tendency, by virtue of its crispness to rebound to an unfolded state. The material once folded and compressed for packaging has a tensioned memory, i.e. compressible into folded creases which have a tendency to unfold, at least partially toward the original unfolded state.

Whereas the collector implement may be utilized for various functions of debris and/or sweepings removal, it is hereinafter described as a dust pan, nonetheless it is claimed as a more universal implement, suitable also as a disposable scoop.

SUMMARY OF INVENTION

The implement as a pop-open dustpan is formed from a blank of compressibly foldable semi-rigid material such as either coated paper, impregnated or laminated papers, and other such blank substances, including plastic. One suitable substance is known as TYVEK (TM) VS #1079 wherein the fold line creases have been impressed previous to formation of the blank into collapsed form. The blank substance has a self-supporting crispness that is useful in its utility mode. Although flexible in nature, the blank upon being snapped and/or popped open will be effectively rigidized for utility when unfolded. This is due in large measure to the tensioned memory of the blank composition wherein the compressibly folded creases tend to unfold at least in part. The blank is in part preferably adhesively supported. The implement cannot be effectively formed therefore, of floppy materials such as cloths unless they may have been reinforced by substrate stiffeners to present a semi-rigid blank. The blank which is basic to forming the invention, is essentially rectangular in flat configuration, before being rigidized by complemental folding steps. The outline of the blank includes transverse and longitudinal projections. The die-cut implement is particularly suited to multiple layered flat or stack packaging wherein all adhesives are protected against exposure, before the implement is popped open.

Essentially there are five basic steps which are requisite to forming the collapsed dust pan from a given die cut blank which has fold lines depressed therein. These five steps are progressive. The steps in forming the dust pan are supplemented not only by pre-folding of preselected portions of the blank but also by the application of permanent adhesive fasteners to minimal preselected, exposed segments of the blank, whereby to secure certain segments in situ before and after the device is popped open and presented for utility. The implement has a utility snap open, pop-up mode of assembly when it has been removed from its compressibly collapsed packaging configuration, reference the ensuing description.

The pop-open dust pan implement is light in weight, readily disposable and when popped-open for usage, sufficiently rigid to enable the user to effect mopping or dusting function without contaminating the user or the user's hands, thus permitting the user to effect the utility functions in a completely sanitary manner. In actual fact, the implement may be used in the cleaning mode independently of a user's grasp. It is also adapted to sequential wrap-up closure, for disposal following the cleaning mode.

DESCRIPTION OF THE PREFERRED EMBODIMENT

Figure 1:
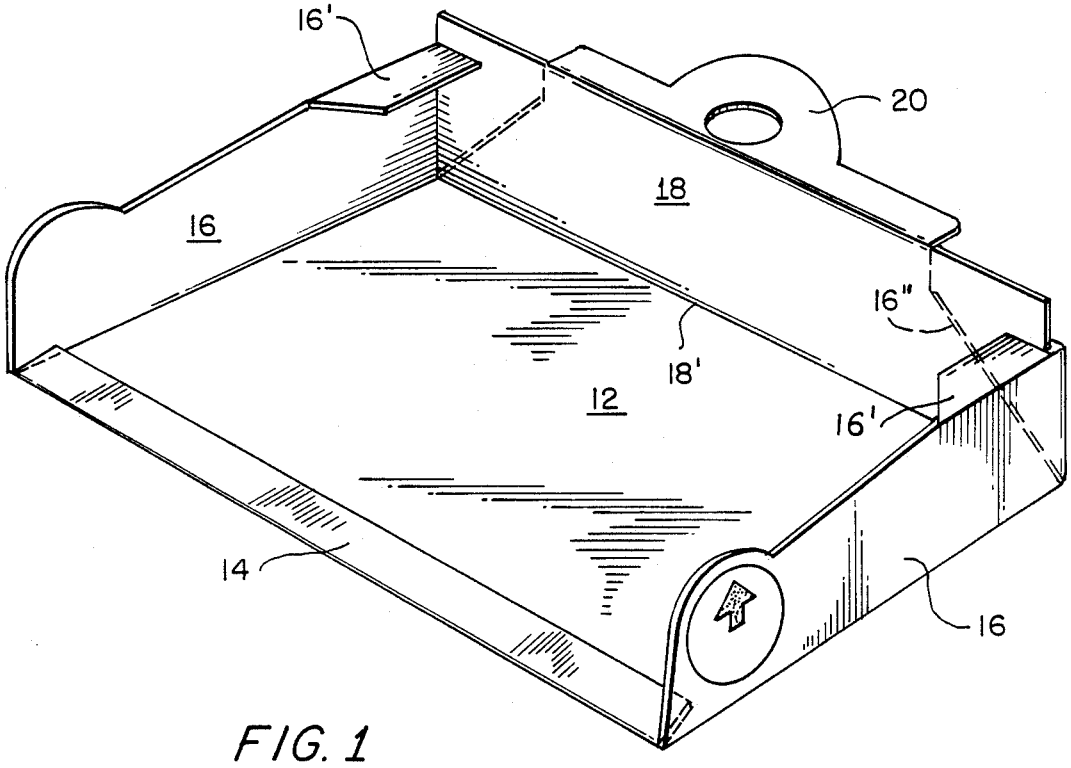
FIG. 1 depicts the invention in its completely erected pop-open utility form, this view being isometric.
Figure 2:
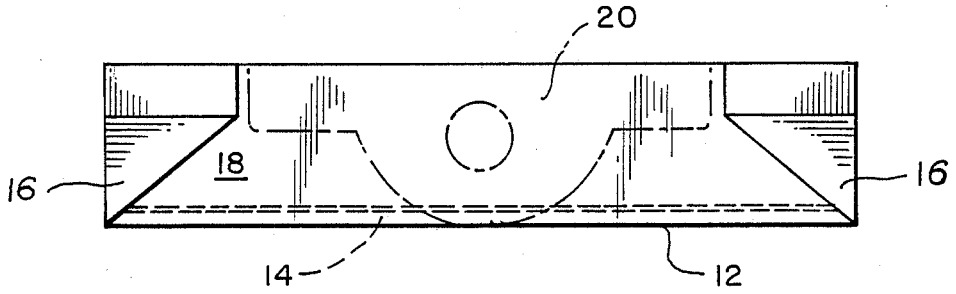
FIG. 2 depicts a rear view in elevation of the invention of FIG. 1.
Figure 3:
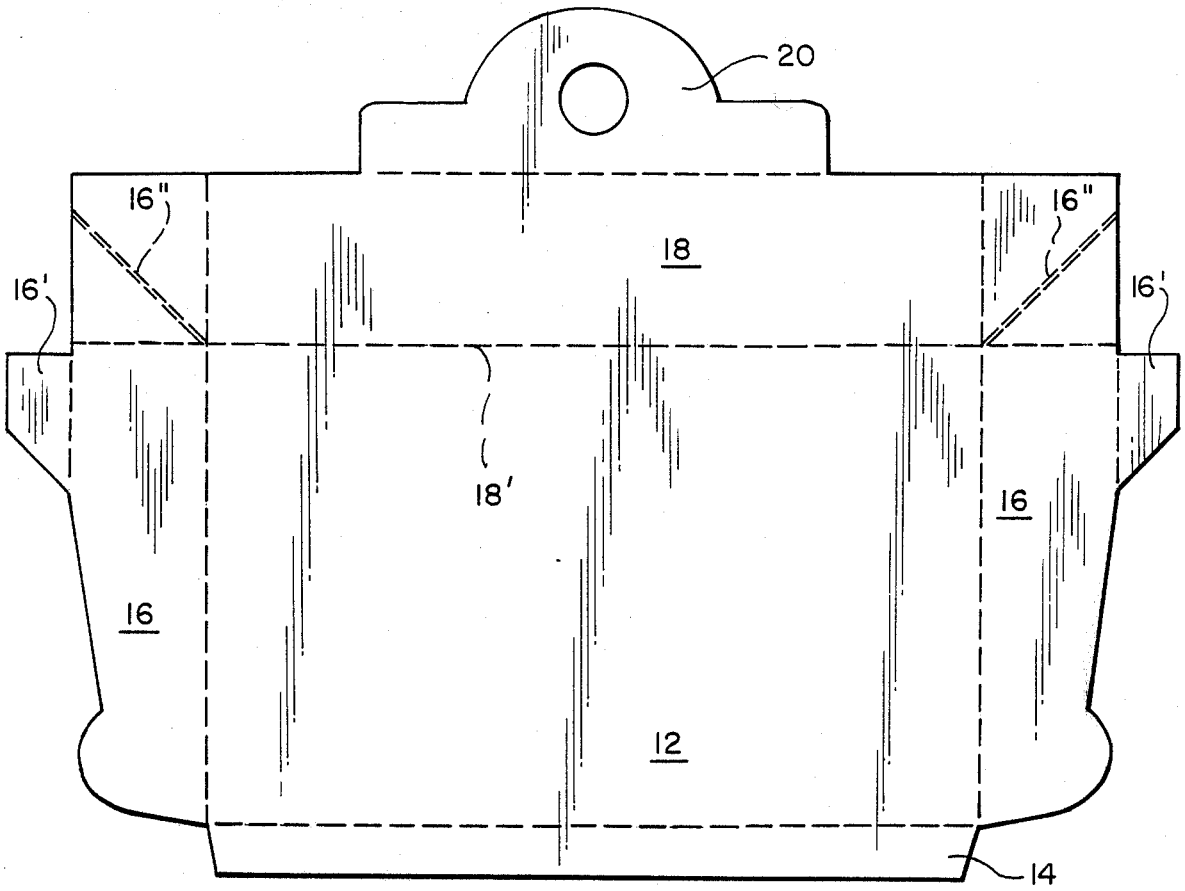
FIG. 3 shows the flat die-cut formation of the blank of the FIGS. 1 and 2 invention, certain fold lines and creases having been embossed thereon.

Referring to FIGS. 1, 2 and 3, the pop-open dustpan comprises in outside appearance, receptacle bottom 12, bounded on its open end by no-spill lip 14. The bottom 12 is bounded laterally by upright side walls 16, with inwardly foldable back wall retaining projections 16', which are offset laterally therefrom. In the rearward enclosed portion of the dustpan, the back wall or abutment 18 connects at a right angle with the collecting bottom 12 as at transverse crease 18' which has beem outwardly embossed in a first fold.

Figure 4:
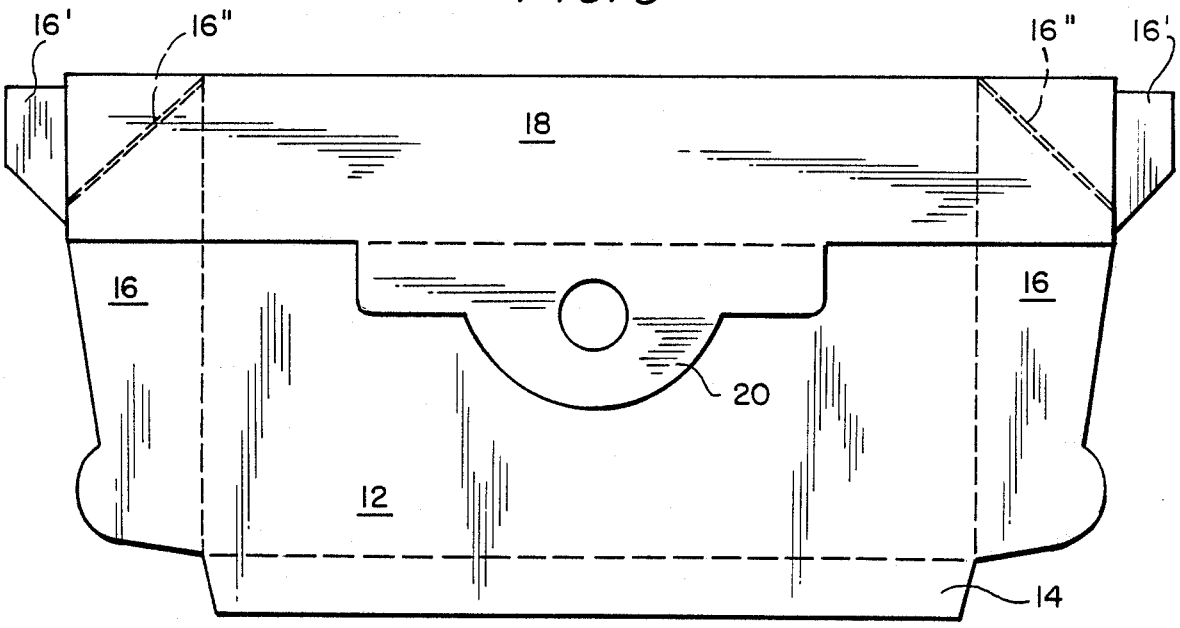
FIG. 4 depicts the invention in its first formative folded stage, back abutment wall and related attachments being shown and folds from the back wall abutment extensions.

This first fold extends from the left extremity to the right extremity of the blank as shown in FIG. 4. Here, the respective lateral extensions of the bottom, form sides 16 at right angle to the first fold 18' to reveal one diagonal crease 16'', the same being a heavy fold crease, which is impressed by embossing outwardly toward the outside rear of the abutment 18. The crease 16'' defines the limit of that somewhat triangular portion of the wall 16 which will be exposed to adhesive 18''. That adhesive is applied to the outside of wall 18 in the manner shown in FIG. 6.

Figure 5:
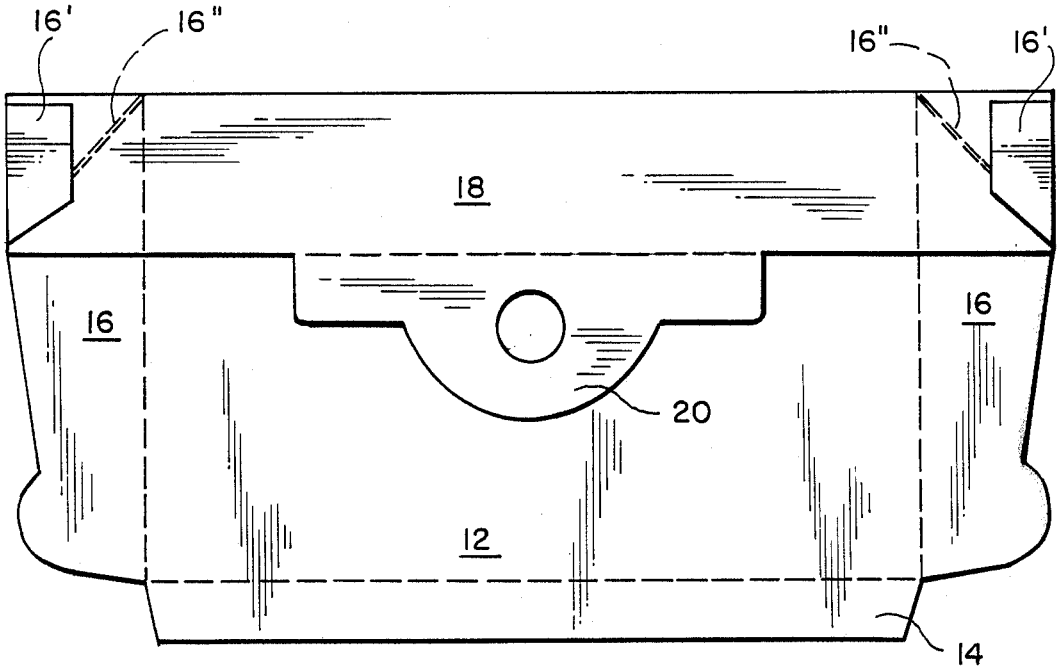
FIG. 5 illustrates the invention blank in its second formative stage wherein back wall retaining projections of side walls are folded inwardly.

A second basic inward fold is effected to tuck the back wall retaining tabs 16' under the side wall 16 in temporary restrained position, relative to the back wall abutment 18. See FIG. 5.

Figure 6:
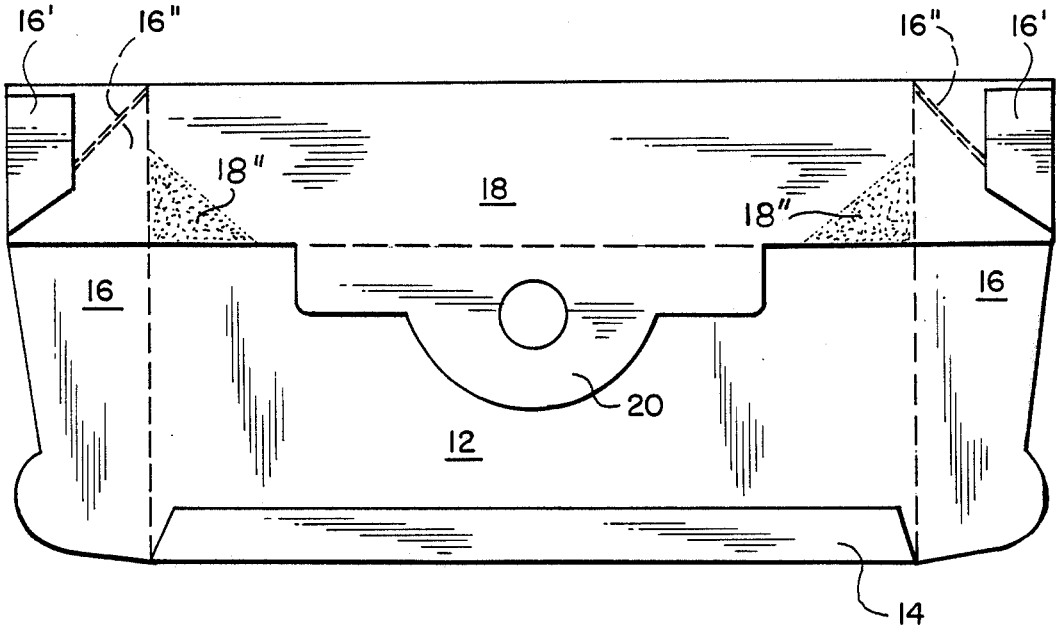
FIG. 6 depicts the third stage of flat construction wherein a no-spill lip is formed at the forward open end concurrently as adhesives for the back wall extensions are applied to segments of the outer back wall.

In FIG. 6 the third fold and concurrent application of sidewall adhesive 18'' is depicted. Here, a substantially permanent setting adhesive is applied opposite the exposed, lapped portion of sidewall extensions 16, whereby to secure those extensions into registry with the rear of abutment 18 in the next construction step, FIG. 7. Likewise, the reinforced no-spill lip 14 is formed by folding back upon itself, the transverse end segment of the bottom 12. On the opposite face of the bottom a transversely disposed pressure sensitive adhesive is applied to coact in useage with the dustpan, by securing it to the surface which is being brushed or mopped. See the phantom line 12' of FIGS. 7 and 8. This is on the reverse side of the bottom for contiguous sticking to the surface being cleaned. In useage the device is removed from the cleaned surface by grasping one or more of the two arrow designated projections and pulling upwardly.

Figure 7:
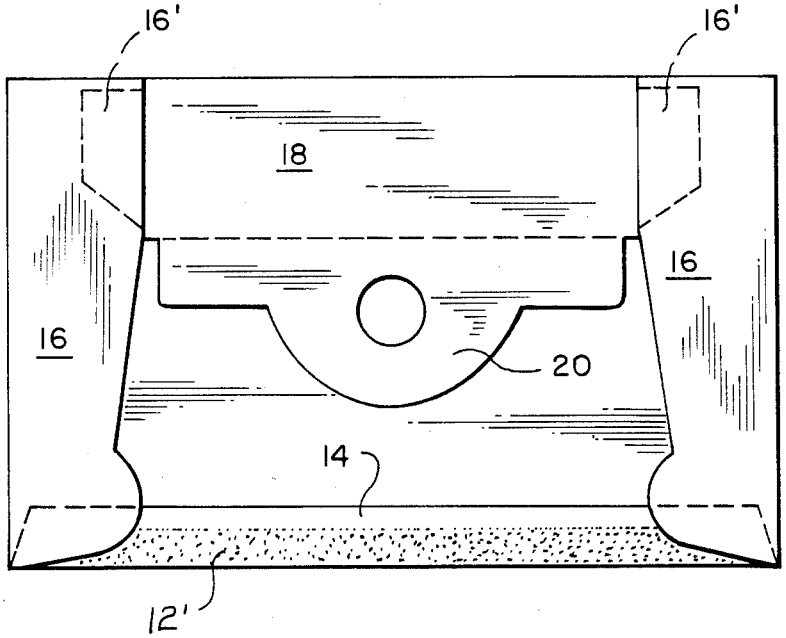
FIG. 7 depicts the fourth stage of flat construction wherein side walls are lapped inwardly over the outer back wall, the inner base and the outer no-spill lip; pressure sensitive adhesive for the reverse side of the bottom is shown in phantom.

Reverting to FIG. 7, the fourth basic fold may be observed to include the lapped upper portion of the sides 16 wherein the sides are closed inwardly over and at right angles to the rear of the abutment 18 and the bottom 12. Opposed segments 16'' and 18'' of FIG. 6 are thus sealed permanently together to retain the lapped rear portions of the sides 16 and abutment 18 in the position which is otherwise best illustrated in FIGS. 2 and 7. Of significance toward effecting the final collapsed and pop-up configurations are the lightly embossed folds 16''. These have preferably each been impressed outwardly during the formation of the blank of FIG. 3 or precedent thereto.

Figure 8:
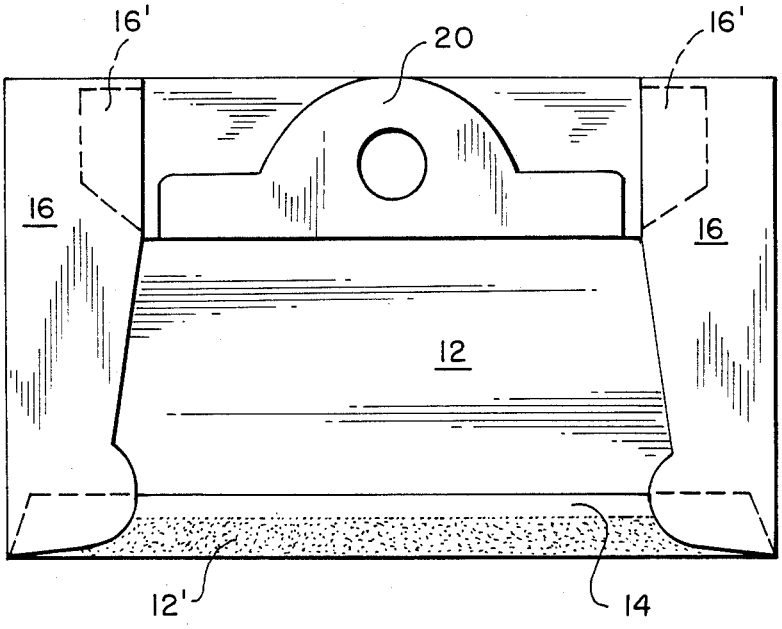
FIG. 8 depicts the fifth stage of flat construction wherein the handle is rotated 180° in reverse to lie against the outer back wall; phantom stippling reveals pressure sensitive adhesive on the exterior of the collector bottom.

Last in the folding process is the laying back of handle 20 onto the rear face of the abutment 18. See. FIG. 8. This is folding step the fifth.

UTILITY OPERATION

To pop-open a collapsed dustpan, the user engages the dustpan open end no-spill lip 14 with thumb and forefinger, while oppositely pulling the tab handle 20 at the closed end with the opposite thumb and forefinger to pop-up the device. By virtue of the restrained disposition of retaining wall tabs 16', between side wall extensions and opposed rear face of the abutment 18 the tabs 16 having a snap-up resiliency will automatically engage the inside rear wall of abutment 18 holding it erect. See. FIG. 1. The upright movement of backwall 18 will force tabs 16' upright into a ninety degree position relative to the walls 16, whereby the inner end of each tab projection will engage the exposed inner wall of abutment 18 to restrain it against collapse. The elastic memory of each tab 16' will prevent collapse thereof against sidewall 16. If depressed against the sidewalls 16, these tabs 16' may permit refolding of the unit, but such a refolding would only be useful for repackaging. Essentially, the unit is intended to be discarded after useage. Adhesive 12' on the reverse of the bottom will adhere the pan to the surface to be cleaned.

We claim:

1. A collapsed, pop-open and disposable debris collector formed of a crisp blank, the composition of which is such that upon folding it tends to rebound to unfolded state, said blank upon folding having a bottom and an interconnected abutment rear wall and opposed side walls; the side walls lapping the rear wall in part in collapsed configuration, permanent adhesive applied to the rear wall, securing a portion of the lapping side walls to the exterior of the rear wall and a spring-like foldable rear wall retainer projection, folded under each said side wall, the projection being extensible upon unfolding to engage the interior of the rear wall, and support same upon pop-opening of the collector from collapsed to pop-up utility configuration.

2. A collapsed pop-open disposible debris collector according to claim 1 wherein a no-spill lip is folded and sprung transversely relative to the side walls, at the open end of the debris collector.

3. The debris pop-open collector of 1 or 2 wherein a segment of pressure sensitive adhesive is exposed upon the exterior of the collector bottom adjacent its open end whereby to provide an anchor of the collector to supporting surfaces to be cleaned allowing the sweeping function to be effected without hands-on gripping.

4. The pop-open debris collector of either 1 or 2, wherein the abutment rear wall defines a collapsible handle extension which in the utility configuration unfolds to project rearwardly of the abutment rear wall.

5. A method of forming a disposable pop-open debris collector from a semi-rigid crisp blank the composition of which is such that it tends to rebound after folding to an unfolded state, wherein the collector defines a flat bottom bounded by open and closed ends, the ends being connected by upright side walls comprising the steps of:

(A) forming a blank with a bottom which is bounded rearwardly by a foldable back wall closed-end extension, the bottom having an opposed frontal no-spill lip extension, as well as lateral foldable side wall extensions with corresponding back wall retaining tab projections laterally disposed thereon, (B) thereafter folding the back wall extension inwardly and sequentially folding side wall extensions to overlap a rear portion of the back wall and bottom portions;

(C) sequentially foldably tucking the back wall retaining projections beneath respective side wall extensions and between said extensions and the back wall;

(D) applying permanent adhesive to portions of the back wall adjacent side wall extensions which overlap same, while simultaneously folding the no-pill lip extension inwardly at the open end upon the collector bottom; and (E) foldably closing the side wall extensions each at right angle to the back wall, thereby sealing contiguous portions of the sides and back wall to retain lapped portions of sides and back wall together which will present a leak-free composition.

6. The method of claim 5 wherein a handle projection is foldably lapped over the exterior of the back wall and wherein exposed pressure-sensitive adhesive is applied to the collector bottom, adjacent the exterior of the open end thereof.

* * * * *